US010596843B2

(12) United States Patent
Sugata

(10) Patent No.: US 10,596,843 B2
(45) Date of Patent: Mar. 24, 2020

(54) PRINTING APPARATUS, PRINTING SYSTEM, AND NON-TRANSITORY COMPUTER READABLE MEDIUM FOR PRINTING

(71) Applicant: FUJI XEROX CO., LTD., Tokyo (JP)

(72) Inventor: Tomokazu Sugata, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/006,929

(22) Filed: Jun. 13, 2018

(65) Prior Publication Data

US 2019/0193440 A1 Jun. 27, 2019

(30) Foreign Application Priority Data

Dec. 27, 2017 (JP) ..... 2017-250660

(51) Int. Cl.
*B41J 29/393* (2006.01)

(52) U.S. Cl.
CPC ..... *B41J 29/393* (2013.01); *B41J 2029/3935* (2013.01)

(58) Field of Classification Search
CPC ..... B41J 29/393; B41J 2029/3935
See application file for complete search history.

(56) References Cited

U.S. PATENT DOCUMENTS 6,312,082 B1 * 11/2001 Lund ..... B41J 2/125 347/100

FOREIGN PATENT DOCUMENTS

JP 2006-187909 7/2006

OTHER PUBLICATIONS

Abstract and machine translation of JP 2006-187909.

* cited by examiner

*Primary Examiner* — Jason S Uhlenhake
(74) *Attorney, Agent, or Firm* — Fildes & Outland, P.C.

(57) ABSTRACT

There is provided a printing apparatus. The printing apparatus includes a memory storing a program; and at least one hardware processor configured to execute a process in the program. The process includes: performing at least one printing operation of pre-printing and post-printing of over-printing which is an operation of performing pre-printing on a medium and then performing post-printing on the medium; and printing one of charts indicating reference positions by the intersection points of reference lines, during test printing related to each of the at least one printing operation, wherein the directions of reference lines corresponding to pre-printing are different from the directions of reference lines corresponding to post-printing.

20 Claims, 10 Drawing Sheets

PRINTING APPARATUS, PRINTING SYSTEM, AND NON-TRANSITORY COMPUTER READABLE MEDIUM FOR PRINTING

CROSS-REFERENCE TO THE RELATED APPLICATIONS

This application is based on and claims priority under 35 USC 119 from Japanese Patent Application No. 2017-250660 filed on Dec. 27, 2017.

BACKGROUND

Technical Field

The present disclosure related to printing apparatus, printing system, and non-transitory computer readable medium.

SUMMARY

According to an aspect of the present invention, there is provided a printing apparatus including: a memory storing a program; and at least one hardware processor configured to execute a process in the program, the process includes: performing at least one printing operation of pre-printing and post-printing of overprinting which is an operation of performing pre-printing on a medium and then performing post-printing on the medium; and printing one of charts indicating reference positions by intersection points of reference lines, during test printing related to each of the at least one printing operation, wherein directions of reference lines corresponding to pre-printing are different from a directions of reference lines corresponding to post-printing.

BRIEF DESCRIPTION OF THE DRAWINGS

Exemplary embodiment(s) of the present invention will be described in detail based on the following figures, wherein.

DETAILED DESCRIPTION

Figure 1:
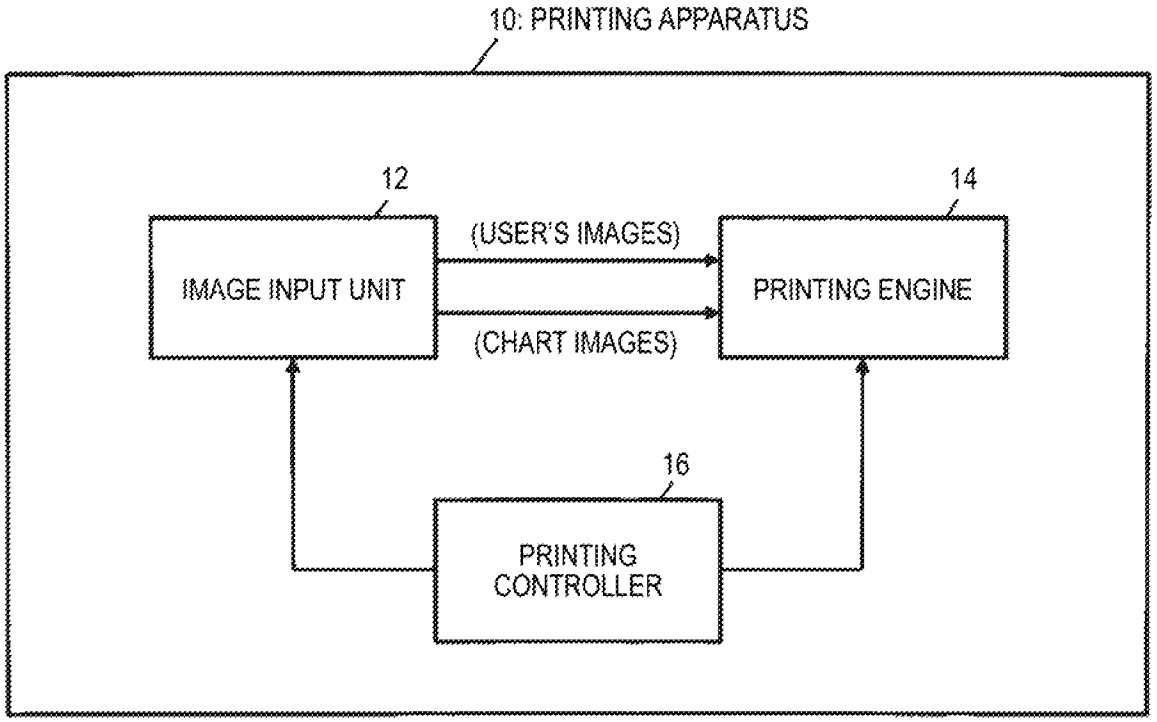
FIG. 1 is a view illustrating a specific example of a printing apparatus according to an exemplary embodiment of the present invention.

FIG. 1 is a view illustrating a specific example of a printing apparatus according to an exemplary embodiment of the present invention. In the specific example shown in FIG. 1, a printing apparatus 10 includes an image input unit 12, a printing engine 14, and a printing controller 16.

To the image input unit 12, print data to be a print object is input. Specific examples of print data are image data (including data on only characters, numbers, and symbols), and image data obtained from an external device such as a computer, or image data read by a scanner or the like can be input to the image input unit 12.

The image input unit 12 outputs, for example, image data of user's images which are print objects based on a printing instruction received from a user, to the printing engine 14. Also, the image input unit 12 outputs image data of a chart image to the printing engine 14 during test printing (to be described below).

The printing engine 14 prints the images (including images of only characters, numbers, and symbols) corresponding to the image data acquired from the image input unit 12, on media such as paper sheets. However, the printing engine 14 may print the images on media other than paper sheets, such as resin sheets, metal sheets, plates, and fabrics.

The printing controller 16 controls the image input unit 12 and the printing engine 14. The printing controller 16 controls the image input unit 12 and the printing engine 14, for example, according to user's operations received via an operation device or the like, such that user's images of images, documents, and the like are printed. Also, the printing controller 16 controls the image input unit 12 and the printing engine 14 during test printing (to be described below) such that image data on a chart image is printed. However, during test printing, a synthetic image of a chart image and a user's image may be printed.

The printing apparatus 10 shown as a specific example in FIG. 1 can be implemented, for example, with a computer. This computer has hardware resources, such as an arithmetic processing unit such as a CPU, storage devices such as a memory and a hard disk, a communication device for using a communication line such as the Internet, a device for reading data from storage media such as optical disks and semiconductor memories and writing data on storage media, a display device such as display, and an operation device for receiving user's operations.

Further, for example, a program (software) corresponding to the image input unit 12 and the printing controller 16 of FIG. 1 can be loaded into the computer, and the hardware resources included in the computer and the loaded software can cooperate with each other such that the functions of the image input unit 12 and the printing controller 16 are implemented by the computer. This program may be provided to the computer via a communication network such as the Internet, or may be stored in a storage medium such as an optical disk and be loaded from the storage medium into the computer. In this case, the printing engine 14 such as a printer may be controlled by the computer having the functions of the image input unit 12 and the printing controller 16.

The printing apparatus 10 shown as an example in FIG. 1 can be used to perform overprinting. During overprinting, first, pre-printing is performed on paper sheets which are printing subjects, and then post-printing is performed on the paper sheets subjected to the pre-printing.

In the specific example shown in FIG. 1, the printing engine 14 of the printing apparatus 10 performs pre-printing of overprinting. Thereafter, post-printing is performed by another engine (not shown in the drawings) (a printing engine provided separately from the printing engine 14). The separate engine for performing post-printing may be provided in another apparatus (a printing apparatus provided separately from the printing apparatus 10), or the printing apparatus 10 may have the printing engine 14 and the separate engine. Alternatively, the printing engine 14 of the printing apparatus 10 may be used several times to perform pre-printing and post-printing.

Also, the printing engine 14 of the printing apparatus 10 may perform post-printing of overprinting. In this case, pre-printing can be performed by another engine (not shown in the drawings) (a printing engine provided separately from the printing engine 14). Also, the separate engine for performing pre-printing may be provided in another apparatus (a printing apparatus provided separately from the printing apparatus 10), or the printing apparatus 10 may have the printing engine 14 and the separate engine.

Also, a specific example of pre-printing is normal printing such as color image printing or monochrome image printing. In the case of performing normal printing as pre-printing, the printing engine (the printing engine 14 or the separate engine) is, for example, an electrophotographic full-color print engine, and prints color images or monochrome images on media such as paper sheets with color toner of four colors C, M, Y, and K which are color materials.

Meanwhile, a specific example of post-printing is special printing using metallic toner, clear toner, or the like. In the case of performing special printing as post-printing, the printing engine (the printing engine 14 or the separate engine) performs special printing using metallic toner, clear toner, white toner, toner of colors (two or more colors or a specific color) other than C, M, Y, and K, or the like.

However, in pre-printing, special printing may be performed, and in post-printing, normal printing may be performed. Also, as overprinting, any other combination other than the combination of normal printing and special printing, such as a combination of normal printing and normal printing and a combination of special printing and special printing may be implemented.

In overprinting which is an operation of performing pre-printing and then performing post-printing, it is desirable to perform adjustment between pre-printing and post-printing. For example, in the case of performing pre-printing by one of two engines and performing post-printing by the other engine, between the two printing engines, printing-position adjustment (misalignment adjustment), magnification adjustment, and so on are performed.

The printing apparatus 10 shown in FIG. 1 has not only a function of performing at least one printing operation of pre-printing and post-printing of overprinting but also a function of performing test printing related to the at least one printing operation. During test printing, the printing engine 14 of the printing apparatus 10 prints charts indicating reference positions by the intersection points of reference lines, on a medium. At this time, the printing engine 14 prints charts in which the directions of reference lines corresponding to pre-printing are different from the directions of reference lines corresponding to post-printing.

Figure 2:
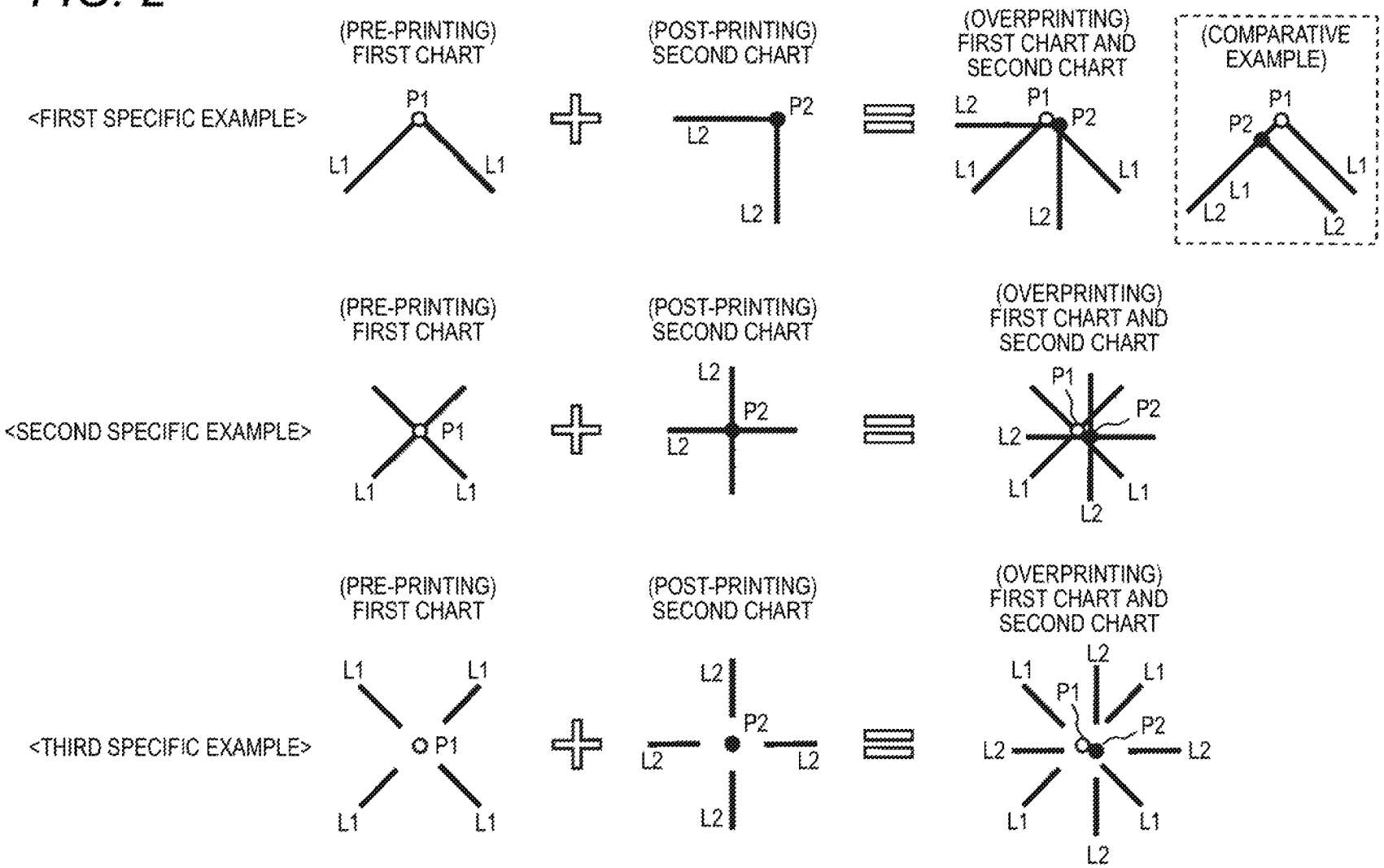
FIG. 2 is a view illustrating specific examples of charts different from one another in the directions of reference lines.

FIG. 2 is a view illustrating specific examples of charts different from one another in the directions of reference lines. FIG. 2 shows specific examples of first charts which can be printed during test printing related to pre-printing, and specific examples of second charts which can be printed during test printing related to post-printing.

First to third specific examples of FIG. 2 show first charts indicating first reference positions P1 by the intersection points of straight lines L1 which are first reference lines to be printed during pre-printing, and second charts indicating second reference positions P2 by the intersection points of straight lines L2 which are second reference lines to be printed during post-printing.

In the first specific example of FIG. 2, a first chart includes an uncinate mark consisting of two straight lines L1, and the corner of the uncinate mark which is the intersection point of the two straight lines L1 indicates a first reference position P1. Also, a second chart includes an uncinate mark consisting of two straight lines L2, and the corner of the uncinate mark which is the intersection point of the two straight lines L2 indicates a second reference position P2. Further, in the first specific example, the directions of first reference lines are different from the directions of second reference lines. In other words, the two straight lines L1 which are the first reference lines are inclined (for example, at 45 degrees) to the transverse direction and longitudinal direction of FIG. 2; whereas the two straight lines L2 which are the second reference lines are parallel with the transverse direction and longitudinal direction of FIG. 2.

In the case where overprinting of the first chart and the second chart is performed on the same paper sheet, the uncinate mark of the first chart and the uncinate mark of the second chart may be printed so as to overlap. In this case, the straight lines L1 intersect with the straight lines L2; however, since the directions of the straight lines L1 (the first reference lines) are different from the directions of the straight lines L2 (the second reference lines), the straight lines L1 never coincide with the straight lines L2. For example, if finding out the angles of the lines for pre-printing and the angles of the lines for post-printing in advance, and performing pre-printing and post-printing, and reading image data of the printed material by an image reading apparatus, and detecting the lines having the angles corresponding to pre-printing and the lines having the angles corresponding to post-printing, from the read image data, it is possible to detect reference points from the intersection point of the lines related to pre-printing and the intersection point of the lines related to post-printing. Further, the distance between the reference points can be used to perform adjustment of image formation position misalignment between pre-printing and post-printing, magnification adjustment, and so on. For example, the difference between the distance between the reference points and a distance predetermined for the reference points may be used to perform adjustment.

For example, if the directions of straight lines L1 are the same as the directions of straight lines L2 like a comparative example (inside a broken-line frame) shown in FIG. 2, the straight lines L1 may coincide with the straight lines L2. For example, in the comparative example of FIG. 2, since one straight line L1 and one straight line L2 overlap each other on the same straight line, the straight line L1 and the straight line L1 overlapping each other may be erroneously detected as one line. In this case, it may be impossible to detect one or both of a first reference position P1 and a second reference position P2, or it may be impossible to determine which of pre-printing and post-printing the detected line has been formed by.

In contrast, in the first specific example of FIG. 2, since the straight lines L1 never coincide with the straight lines L2, unlike the comparative example, it is possible to detect both of the first reference position P1 and the second reference position P2, without erroneous detection.

In the second specific example of FIG. 2, a first chart includes an X-shaped mark consisting of two straight lines L1, and the center of the X-shaped mark which is the intersection point of the two straight lines L1 indicates a first reference position P1. Also, a second chart includes a plus-sign-shaped mark consisting of two straight lines L2, and the center of the plus-sign-shaped mark which is the intersection point of the two straight lines L2 indicates a second reference position P2. Further, even in the second specific example, the directions of first reference lines are different from the directions of second reference lines. In other words, the two straight lines L1 which are the first reference lines are inclined (for example, at 45 degrees) to the transverse direction and longitudinal direction of FIG. 2; whereas the two straight lines L2 which are the second reference lines are parallel with the transverse direction and longitudinal direction of FIG. 2.

In the case where overprinting of the first chart and the second chart is performed on the same paper sheet, the X-shaped mark of the first chart and the plus-sign-shaped mark of the second chart may be printed so as to overlap. In this case, the straight lines L1 intersect with the straight lines L2; however, since the directions of the straight lines L1 (the first reference lines) are different from the directions of the straight lines L2 (the second reference lines), the straight lines L1 never coincide with the straight lines L2. Therefore, even in the second specific example, unlike the comparative example, it is possible to detect both of the first reference position P1 and the second reference position P2, without erroneous detection.

Figure 3:
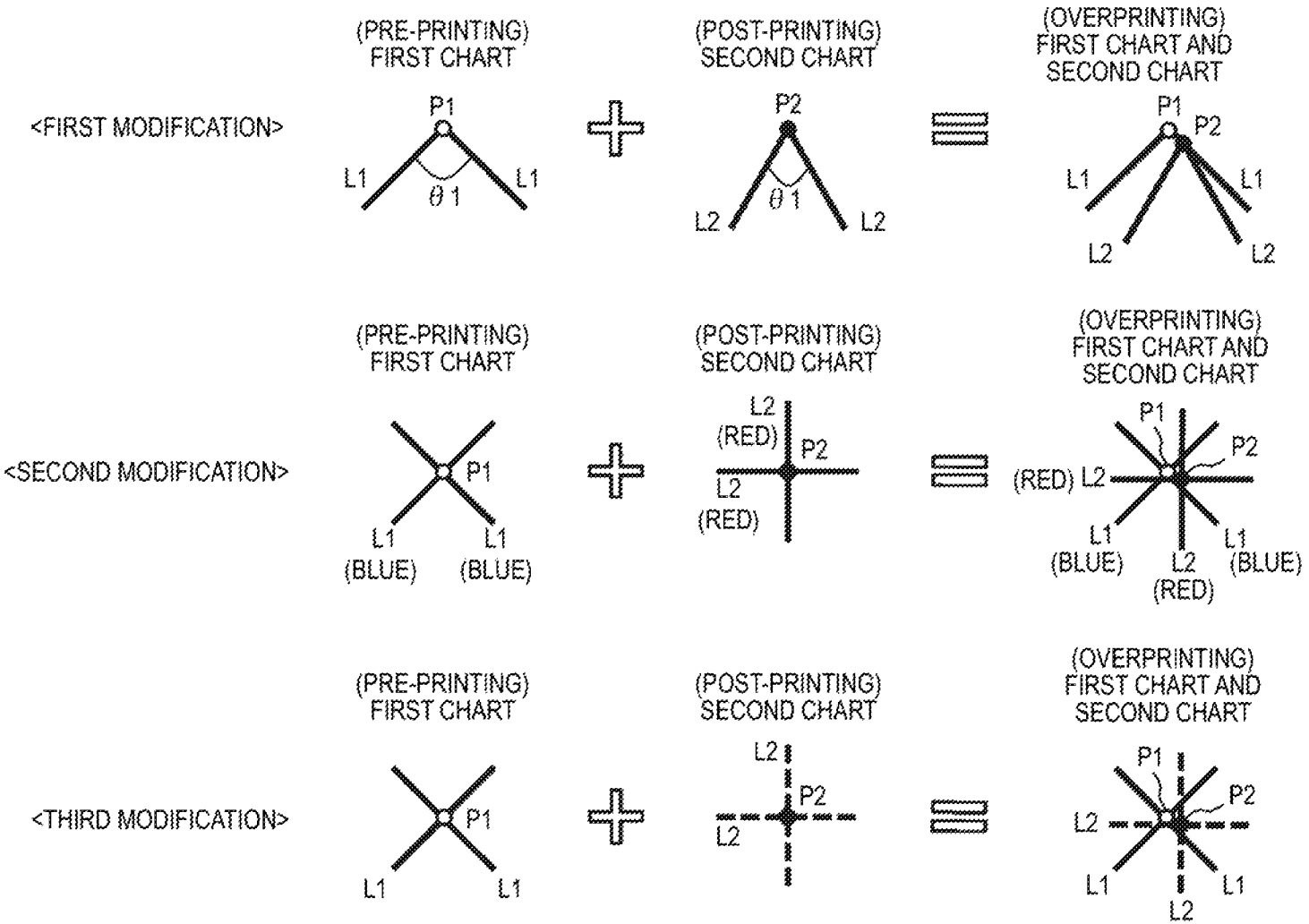
FIG. 3 is a view illustrating modifications of charts different from one another in the directions of reference lines.

In the third specific example of FIG. 3, a first chart includes an X-shaped mark consisting of four straight lines L1. In the third specific example, in the first chart, the straight lines L1 do not intersect, and the center of the X-shaped mark which is the intersection point of extension lines of the straight lines L1 (the intersection point of straight lines each of which is an extension line of two straight lines L1 parallel with each other) indicates a first reference position P1.

Also, in the third specific example, a second chart includes a plus-sign-shaped mark consisting of four straight lines L2. In the second chart, the straight lines L2 do not intersect, and the center of the plus-sign-shaped mark which is the intersection point of extension lines of the straight lines L2 (the intersection point of straight lines each of which is an extension line of two straight lines L2 parallel with each other) indicates a second reference position P2.

Further, even in the third specific example, the directions of first reference lines are different from the directions of second reference lines. In other words, the four straight lines L1 which are the first reference lines are inclined (for example, at 45 degrees) to the transverse direction and longitudinal direction of FIG. 2; whereas the four straight lines L2 which are the second reference lines are parallel with the transverse direction and longitudinal direction of FIG. 2.

In the case where overprinting of the first chart and the second chart is performed on the same paper sheet, the X-shaped mark of the first chart and the plus-sign-shaped mark of the second chart may be printed so as to overlap. Even in this case, since the directions of the straight lines L1 (the first reference lines) are different from the directions of the straight lines L2 (the second reference lines), the straight lines L1 never coincide with the straight lines L2. Therefore, even in the third specific example, unlike the comparative example, it is possible to detect both of the first reference position P and the second reference position P2, without erroneous detection.

Further, in the third specific example, since the straight lines L1 and the straight lines L2 are arranged at positions apart from the first reference position P1 and the second reference position P2, as compared to the first and second specific examples, the possibility that the straight lines L1 will intersect with the straight lines L2 is lower. Needless to say, even though the straight lines L1 intersect with the straight lines L2, since the directions of the straight lines L1 are different from the directions of the straight lines L2, erroneous detection attributable to coincidence of the straight lines L1 and the straight lines L2 does not occur, and it is possible to detect both of the first reference position P1 and the second reference position P2.

As shown in the third specific example of FIG. 2, even though reference lines do not intersect on a chart, for example, a reference position may be indicated by the intersection point of extension lines of the reference lines.

FIG. 3 is a view illustrating modifications of charts different from one another in the directions of reference lines. FIG. 3 shows specific examples of first charts which can be printed during test printing related to pre-printing, and specific examples of second charts which can be printed during test printing related to post-printing.

First to third modifications of FIG. 3 show first charts indicating first reference positions P1 by the intersection points of straight lines L1 which are first reference lines to be printed during pre-printing, and second charts indicating second reference positions P2 by the intersection points of straight lines L2 which are second reference lines to be printed during post-printing.

In the first mark of FIG. 3, a first chart includes an uncinate mark consisting of two straight lines L1, and the corner of the uncinate mark which is the intersection point of the two straight lines L1 indicates a first reference position P1. Also, a second chart includes an uncinate mark consisting of two straight lines L2, and the corner of the uncinate mark which is the intersection point of the two straight lines L2 indicates a second reference position P2. Further, the directions of first reference lines (the straight lines L1) are different from the directions of second reference lines (the straight lines L2).

In the case where overprinting of the first chart and the second chart is performed on the same paper sheet, the uncinate mark of the first chart and the uncinate mark of the second chart may be printed so as to overlap. In this case, the straight lines L1 intersect with the straight lines L2; however, since the directions of the straight lines L1 (the first reference lines) are different from the directions of the straight lines L2 (the second reference lines), the straight lines L1 never coincide with the straight lines L2. Therefore, erroneous detection attributable to coincidence of the straight lines L1 and the straight lines L2 does not occur, and it is possible to detect both of the first reference position P1 and the second reference position P2.

Further, in the first modification of FIG. 3, the angle between the first reference lines is different from the angle between the second reference lines. In other words, the intersection angle $\theta 1$ between the two straight lines L1 which are the first reference lines is different from the intersection angle $\theta 2$ between the two straight lines L2 which are second reference lines ($\theta 1 \neq \theta 2$).

Therefore, for example, in the case where straight lines are detected from image data obtained from a paper sheet having the first chart and the second chart printed thereon by overprinting, it is possible to recognize that two straight lines intersecting at the intersection angle θ1 are the two straight lines L1, and it is possible to recognize that two straight lines intersecting at the intersection angle θ2 are the two straight lines L2. In other words, since the angles between the reference lines are different from each other (θ1≠θ2), it is possible to discriminate between the first reference lines (the intersection angle θ1) of the first chart corresponding to pre-printing and the second reference lines (the intersection angle θ2) of the second chart corresponding to post-printing.

In the second modification of FIG. 3, a first chart includes an X-shaped mark consisting of two straight lines L1, and the center of the X-shaped mark which is the intersection point of the two straight lines L1 indicates a first reference position P1. Also, a second chart includes a plus-sign-shaped mark consisting of two straight lines 12, and the center of the plus-sign-shaped mark which is the intersection point of the two straight lines L2 indicates a second reference position P2.

Further, similarly to the second specific example of FIG. 2, even in the second modification of FIG. 3, the directions of first reference lines are different from the directions of second reference lines. In other words, the two straight lines L1 which are the first reference lines are inclined (for example, at 45 degrees) to the transverse direction and longitudinal direction of FIG. 3, whereas the two straight lines L2 which are the second reference lines are parallel with the transverse direction and longitudinal direction of FIG. 3.

In the case where overprinting of the first chart and the second chart is performed on the same paper sheet, the X-shaped mark of the first chart and the plus-sign-shaped mark of the second chart may be printed so as to overlap. However, for the same reason as that of the second specific example of FIG. 2, even in the second modification of FIG. 3, erroneous detection attributable to coincidence of the straight lines L1 and the straight lines L2 does not occur, and it is possible to detect both of the first reference position P1 and the second reference position P2.

Further, in the second modification of FIG. 3, the color of the first reference lines is different from the color of the second reference lines. For example, the two straight lines L1 which are the first reference lines are blue, and the two straight lines L2 which are second reference lines are red.

Therefore, for example, in the case where straight lines are detected from image data obtained from a paper sheet having the first chart and the second chart printed thereon by overprinting, it is possible to recognize that blue straight lines are the two straight lines L1 which are the first reference lines, and it is possible to recognize that red lines are the two straight lines L2 which are the second reference lines. In other words, due to the difference between the colors of the reference lines, it is possible to discriminate between the first reference lines of the first chart corresponding to pre-printing and the second reference lines of the second chart corresponding to post-printing. Needless to say, any other color combination different from the combination of blue and red can be used, and it is also possible to make a brightness or density difference between the first reference lines and the second reference lines such that it is possible to discriminate between the first reference lines and the second reference lines due to the luminance difference. The above-mentioned color difference is not limited to a hue difference, and may be a saturation difference, a brightness difference, a density difference, or the like.

Also, as shown in the third modification of FIG. 3, it is also possible to make a line type difference between first reference lines and second reference lines. In the third modification of FIG. 3, two straight lines L1 which are first reference lines are solid lines, and two straight lines L2 which are second reference lines are broken lines.

Therefore, for example, in the case where straight lines are detected from image data obtained from a paper sheet having the first chart and the second chart printed thereon by overprinting, it is possible to recognize that straight lines which are solid lines are the two straight lines L1 which are the first reference lines, and it is possible to recognize that straight lines which are broken lines are the two straight lines L2 which are the second reference lines. In other words, due to the difference between the types (solid line, broken line, alternate long and short dash line, and so on) of the reference lines, it is possible to discriminate between the first reference lines of the first chart corresponding to pre-printing and the second reference lines of the second chart corresponding to post-printing.

Also, for the same reason as that of the third specific example of FIG. 2, even in the third modification of FIG. 3, erroneous detection attributable to coincidence of the straight lines L1 and the straight lines L2 does not occur, and it is possible to detect both of the first reference position P1 and the second reference position P2.

Also, it is possible to arrange a first reference position corresponding to pre-printing and a second reference position corresponding to post-printing at different positions.

Figure 4:
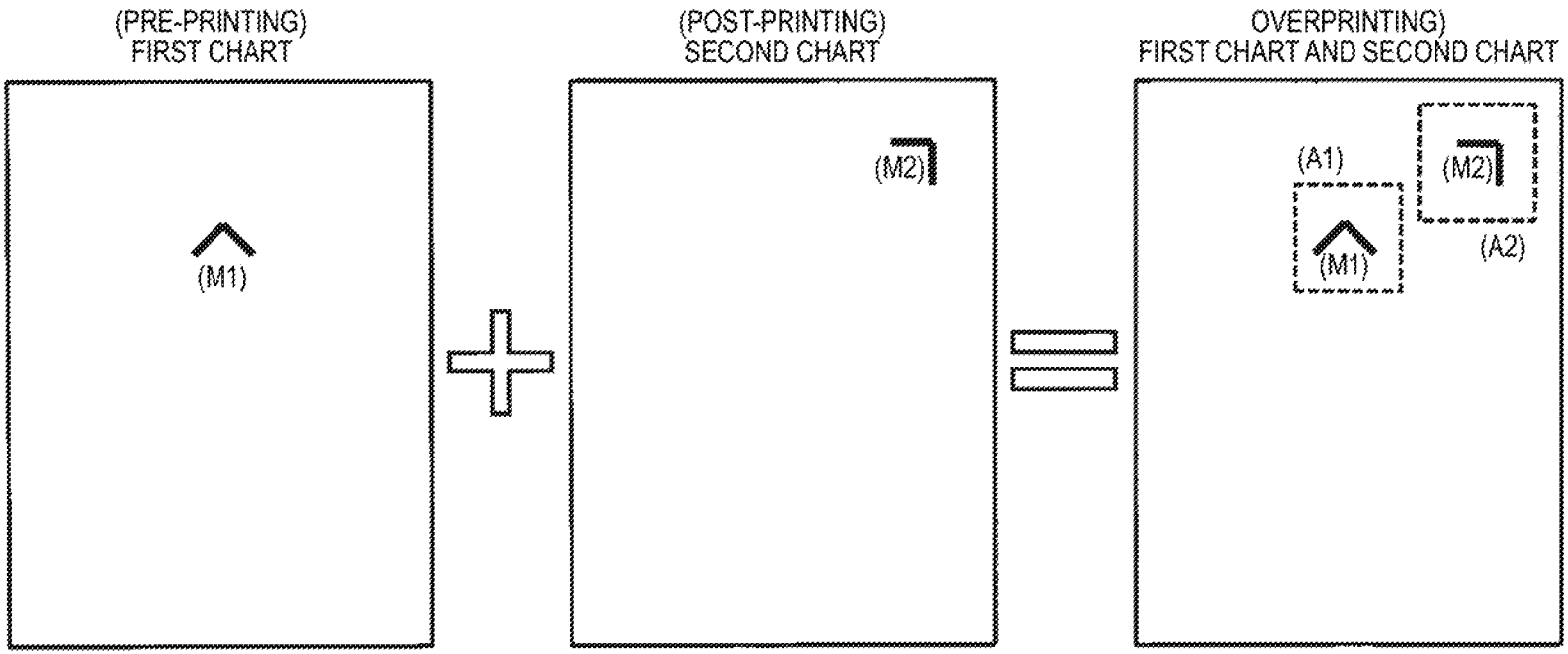
FIG. 4 is a view illustrating specific examples of a first chart and a second chart in which a first reference position and a second reference position are at positions different from each other.

FIG. 4 is a view illustrating specific examples of a first chart and a second chart having a first reference position and a second reference position arranged at different positions.

In the specific examples shown in FIG. 4, a first chart which can be printed during pre-printing includes an uncinate mark M1 consisting of first reference lines (two straight lines), and the corner of the uncinate mark which is the intersection point of the two straight lines indicates a first reference position (see the first specific example of FIG. 2). Also, a second chart which can be printed during post-printing includes an uncinate mark M2 consisting of second reference lines (two straight lines), and the corner of the uncinate mark which is the intersection point of the two straight lines indicates a second reference position (see the first specific example of FIG. 2). Further, the directions of the first reference lines are different from the directions of the second reference lines. Furthermore, in the specific examples shown in FIG. 4, the first reference position and the second reference position are arranged at different positions apart from each other.

Therefore, for example, in the case where straight lines are detected from image data obtained from a paper sheet having the first chart and the second chart printed thereon by overprinting, it is possible to recognize that straight lines included, for example, in a search area A1 (for example, a search area having an ideal position of the first reference position as the center) corresponding to the first reference position are the first reference lines constituting the uncinate mark M1, and it is possible to recognize that straight lines included, for example, in a search area A2 (for example, a search area having an ideal position of the second reference position as the center) corresponding to the second reference position are the second reference lines constituting the uncinate mark M2. In other words, due to the difference between the positions where the reference lines are arranged, it is possible to discriminate between the first reference position indicated by the first reference lines (the uncinate mark M1) included in the first chart corresponding to pre-printing and the second reference position indicated by the second reference lines (the uncinate mark M2) included in the second chart corresponding to post-printing while detecting both of the first reference position and the second reference position.

Figure 5:
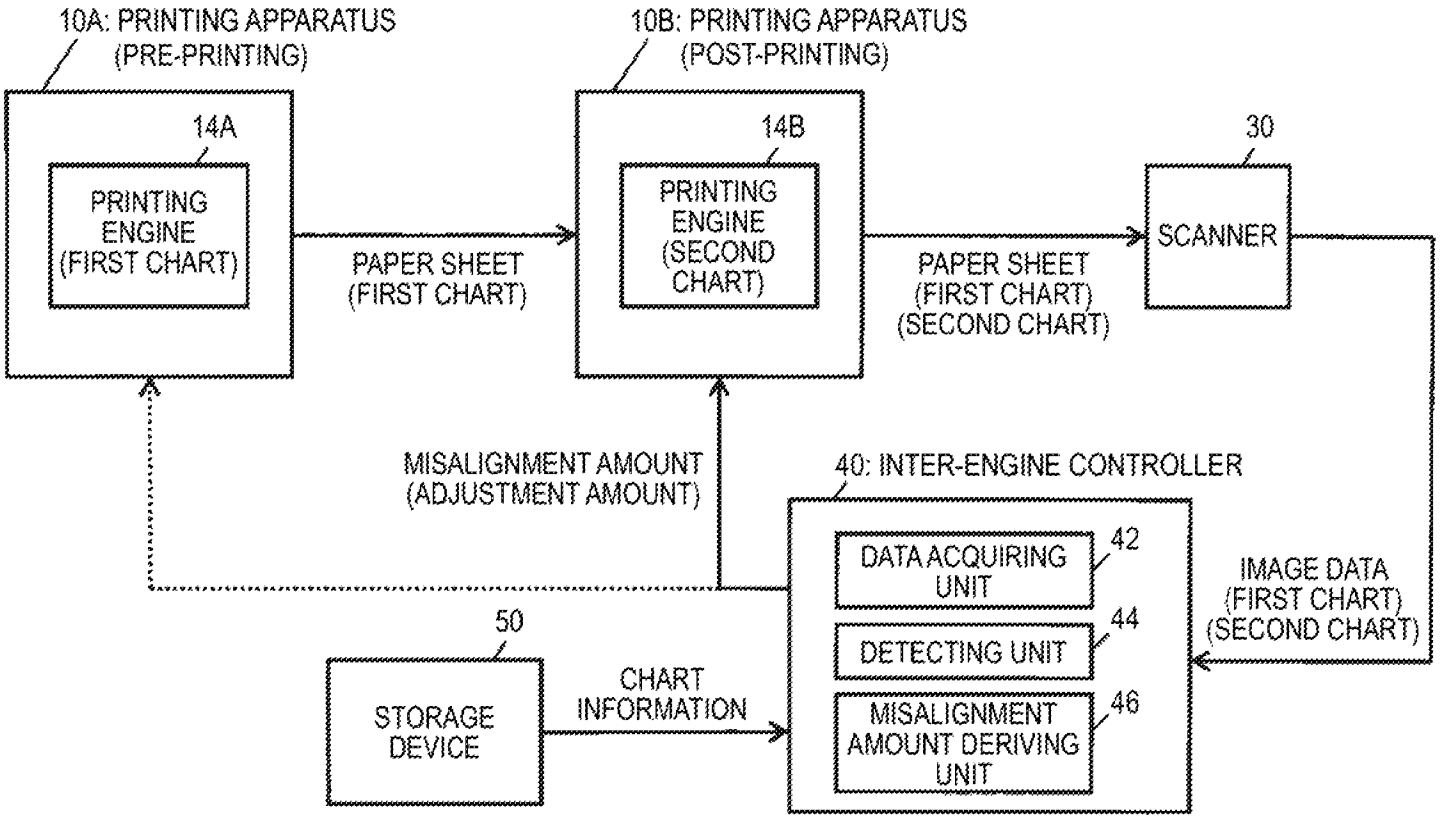
FIG. 5 is a view illustrating a specific example of a printing system according to the exemplary embodiment of the present invention.

FIG. 5 is a view illustrating a specific example of a printing system according to the exemplary embodiment of the present invention. FIG. 5 shows a specific example of a printing system for performing overprinting which is an operation of performing pre-printing on a medium and then performing post-printing on the medium. In the specific example shown in FIG. 5, a printing system includes a printing apparatus 10A, a printing apparatus 10B, a scanner 30, an inter-engine controller 40, and a storage device 50.

The printing apparatus 10A includes a printing engine 14A for performing pre-printing on media such as paper sheets. A specific example of the printing apparatus 10A is the printing apparatus 10 shown in FIG. 1. Also, in the printing system of FIG. 5, a specific example of pre-printing which the printing apparatus 10A performs is normal printing such as color image printing or monochrome image printing. In the case of performing normal printing as pre-printing, the printing engine 14A is, for example, an electrophotographic full-color print engine, and prints color images or monochrome images on media such as paper sheets with color toner of four colors C, M, Y, and K which are color materials.

The printing apparatus 10B includes a printing engine 14B for performing post-printing on media such as paper sheets subjected to pre-printing. A specific example of the printing apparatus 10B is the printing apparatus 10 shown in FIG. 1. Also, in the printing system of FIG. 5, a specific example of post-printing which the printing apparatus 10B performs is special printing using metallic toner, clear toner, or the like. In the case of performing special printing as post-printing, the printing engine 14B performs special printing using metallic toner, clear toner, or the like, on paper sheets on which, for example, normal printing has been performed as pre-printing. However, special printing using white toner, toner of colors (two or more colors or a specific color) other than C, M, Y, and K, or the like may be performed.

For example, in main printing which is performed after test printing, normal printing (color image printing or monochrome image printing) of user's images which are print objects based on a printing instruction received from the user is performed by the printing apparatus 10A, and then special printing is performed on the paper sheets subjected to the normal printing by the printing apparatus 10B. In this way, for example, a special visual effect using metallic toner, clear toner, white toner, toner of colors (two or more colors or a specific color) other than C, M, Y, and K, or the like is imparted to the user's images, such as images and documents, printed on the paper sheets.

However, in the specific example shown in FIG. 5, special printing may be performed as pre-printing, and normal printing may be performed as post-printing. Also, as overprinting, any other combination other than the combination of normal printing and special printing, such as a combination of normal printing and normal printing and a combination of special printing and special printing may be performed.

The printing system shown as an example in FIG. 4 has a function of performing test printing for adjustment for overprinting. In other words, the printing engine 14A of the printing apparatus 10A performs test printing related to pre-printing, and the printing engine 14B of the printing apparatus 10B performs test printing related to post-printing.

The printing engine 14A of the printing apparatus 10A prints a first chart indicating a first reference position by the intersection point of first reference lines, on a paper sheet (a medium), during test printing related to pre-printing. During test printing related to pre-printing, the printing engine 14A may print, for example, a first chart of a specific example described with reference to FIG. 2 to FIG. 4, on a paper sheet. Alternatively, during test printing, the printing engine 14A may print a user's image (an image to be printed during main printing after test printing) together with a first chart on a paper sheet.

The printing engine 14B of the printing apparatus 10B prints a second chart indicating a second reference position by the intersection point of second reference lines different from the first reference lines, on the paper sheet (the medium) having the first chart printed thereon, during test printing related to post-printing. During test printing related to post-printing, the printing engine 14B may print, for example, a second chart of a specific example described with reference to FIG. 2 to FIG. 4, on the paper sheet.

Thereafter, the scanner 30 optically reads image data of the paper sheet (the medium) having the first chart and the second chart printed thereon. In this way, the image data of the first chart and the second chart printed on the paper sheet is read. The scanner 30 transmits the read image data to the inter-engine controller 40.

The inter-engine controller 40 includes a data acquiring unit 42, a detecting unit 44, and a misalignment amount deriving unit 46 for adjusting image position misalignment between pre-printing and post-printing. The data acquiring unit 42 acquires the image data obtained from the scanner 30. The detecting unit 44 detects the first reference position of pre-printing and the second reference position of post-printing from the image data acquired by the data acquiring unit 42. The misalignment amount deriving unit 46 derives the amount of misalignment between the printing position of pre-printing and printing position of the post-printing, using the relative position relationship between the first reference position and the second reference position detected by the detecting unit 44.

In the storage device 50, chart information on the first chart and the second chart is stored in advance. In processing which is performed by the inter-engine controller 40, the chart information stored in storage device 50 is used.

However, for example, a multi-function apparatus having a printing function and a copying function may be used to implement a configuration having both of the function of the printing apparatus 10A or the printing apparatus 10B and the function of the scanner 30, and that multi-function apparatus may be used to implement a configuration having the function of the inter-engine controller 40.

Also, the inter-engine controller 40 may be implemented with, for example, a computer. This computer has hardware resources, such as an arithmetic processing unit such as a CPU, storage devices such as a memory and a hard disk, a communication device for using a communication line such as the Internet, a device for reading data from storage media such as optical disks and semiconductor memories and writing data on storage media, a display device such as display, and an operation device for receiving user's operations.

Further, for example, a program (software) corresponding to the data acquiring unit 42, the detecting unit 44, and the misalignment amount deriving unit 46 shown in FIG. 5 can be loaded into the computer, and the hardware resources included in the computer and the loaded software can cooperate with each other such that the function of at least one of the data acquiring unit 42, the detecting unit 44, and the misalignment amount deriving unit 46 is implemented by the computer. This program may be provided to the computer via a communication network such as the Internet, or may be stored in a storage medium such as an optical disk and be loaded from the storage medium into the computer.

Now, a specific example of test printing which is performed by the printing system of FIG. 5 will be described. Also, in the following description, components identical to those (the units having reference symbols) of FIG. 5 are denoted by the same reference symbols as those of FIG. 5.

In the printing system of FIG. 5, the printing engine 14A of the printing apparatus 10A prints a first chart indicating a first reference position by the intersection point of first reference lines, on a paper sheet, during test printing related to pre-printing, and then the printing engine 14B of the printing apparatus 10B prints a second chart indicating a second reference position by the intersection point of second reference lines having directions different from the directions of the first reference lines, on the paper sheet having the first chart printed thereon. Subsequently, the scanner 30 reads image data of the first chart and the second chart printed on the paper sheet, and from the image data read by the scanner 30, the detecting unit 44 of the inter-engine controller 40 detects the first reference position of pre-printing and the second reference position of post-printing.

The image data of the first chart and the second chart includes straight lines constituting the first reference lines and the second reference lines. The detecting unit 44 of the inter-engine controller 40 first detects the straight lines from the image data of the first chart and the second chart.

Figure 6:
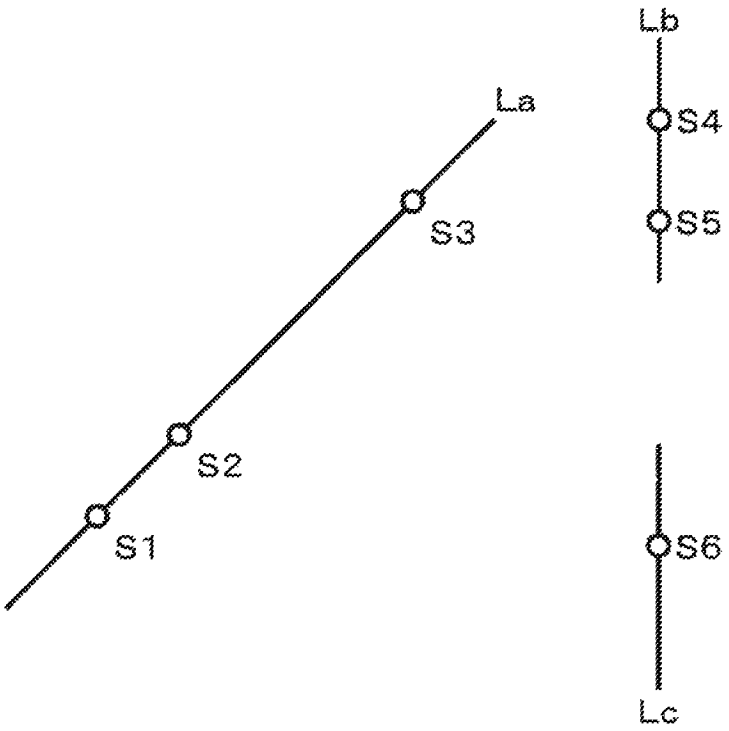
FIG. 6 is a view illustrating a specific example of straight-line detection which is performed by a detecting unit.

FIG. 6 is a view illustrating a specific example of detection of straight lines from image data. The detecting unit 44 of the inter-engine controller 40 detects sample points existing on images of straight lines, from the image data acquired from the scanner 30 by the data acquiring unit 42, for example, using a known image detection process or the like. In the specific example shown in FIG. 6, six detected sample points (S1 to S6) are shown.

In the case where three or more of the detected sample points are on one straight line, the detecting unit 44 detects a straight line connecting the three or more sample points, as a reference line. For example, in the specific example shown in FIG. 6, three sample points (S1 to S3) are on one straight line. Therefore, the detecting unit 44 detects a straight line La connecting the three sample points (S1 to S3), as a reference line.

Also, in the specific example shown in FIG. 6, three other sample points (S4 to S6) are on one straight line. Therefore, the detecting unit 44 detects a straight line connecting the three sample points (S4 to S6), i.e. a straight line Lb and a straight line Lc existing side by side on one straight line, as one reference line. Therefore, even in the case where there is a reference position between the straight line Lb and the straight line Lc (see the third specific example of FIG. 2), a reference line passing through the corresponding reference position is detected.

In this way, for example, by straight-line detection described with reference to FIG. 6, straight lines constituting the first reference lines and straight lines constituting the second reference lines are detected from the image data of the first chart and the second chart.

If straight lines are detected, the detecting unit 44 of the inter-engine controller 40 detects reference positions which are the intersection points of the straight lines detected from the image data.

For example, in image data corresponding to the first chart and the second chart of any one of the first to third specific examples shown in FIG. 2, the straight lines L1 which are the first reference lines intersect at a right angle, and the straight lines L2 which are the second reference lines also intersect at a right angle. Therefore, for example, the intersection points of straight lines intersecting at a right angle, of straight lines detected from the image data, are detected as reference positions (the first reference position P1 and the second reference position P2 shown in FIG. 2).

Further, if a difference is made between the first reference lines and the second reference lines, for example, like the first to third modifications shown in FIG. 3, it is possible to discriminate between the first reference position P1 of pre-printing and the second reference position P2 of post-printing, and detect the first and second reference positions.

For example, in image data corresponding to the first chart and the second chart of the first modification shown in FIG. 3, the straight lines L1 which are the first reference lines intersect at the intersection angle θ1, and the straight lines L2 which are the second reference lines intersect at the intersection angle θ2. Therefore, for example, the intersection point of straight lines intersecting at the intersection angle θ1, of straight lines detected from the image data, is detected as the first reference position P1, and the intersection point of straight lines intersecting at the intersection angle θ2 is detected as the second reference position P2.

Also, in image data corresponding to the first chart and the second chart of the second specific example shown in FIG. 3, the straight lines L1 which are the first reference lines are blue, and the straight lines L2 which are the second reference lines are red. Therefore, the intersection point of blue straight lines of straight lines detected from the image data is detected as the first reference position P1, and the intersection point of red straight lines is detected as the second reference position P2.

Also, in image data corresponding to the first chart and the second chart of the third specific example shown in FIG. 3, the straight lines L1 which are the first reference lines are solid lines, and the straight lines L2 which are the second reference lines are broken lines. Therefore, the intersection point of straight lines which are solid lines, of straight lines detected from the image data, is detected as the first reference position P1, and the intersection point of straight lines which are broken lines is detected as the second reference position P2.

Also, if a first reference position and a second reference position are arranged at different positions, for example, like the specific example shown in FIG. 4, it is possible to discriminate between the first reference position and the second reference position, and detect the first and second reference positions. For example, in image data corresponding to the first chart and the second chart of the specific example shown in FIG. 4, the intersection point of straight lines existing in the search area A1, of straight lines detected from the image data, is detected as the first reference position P1, and the intersection point of straight lines existing in the search area A2 is detected as the second reference position P2.

If the first reference position and the second reference position are detected by the detecting unit 44, the misalignment amount deriving unit 46 derives the amount of misalignment between the printing position of pre-printing and the printing position of post-printing, using the relative position relationship between the first reference position and the second reference position detected. To derive the amount of misalignment, it is desirable to use charts each of which indicates two or more reference positions on a paper sheet (a medium).

Figure 7:
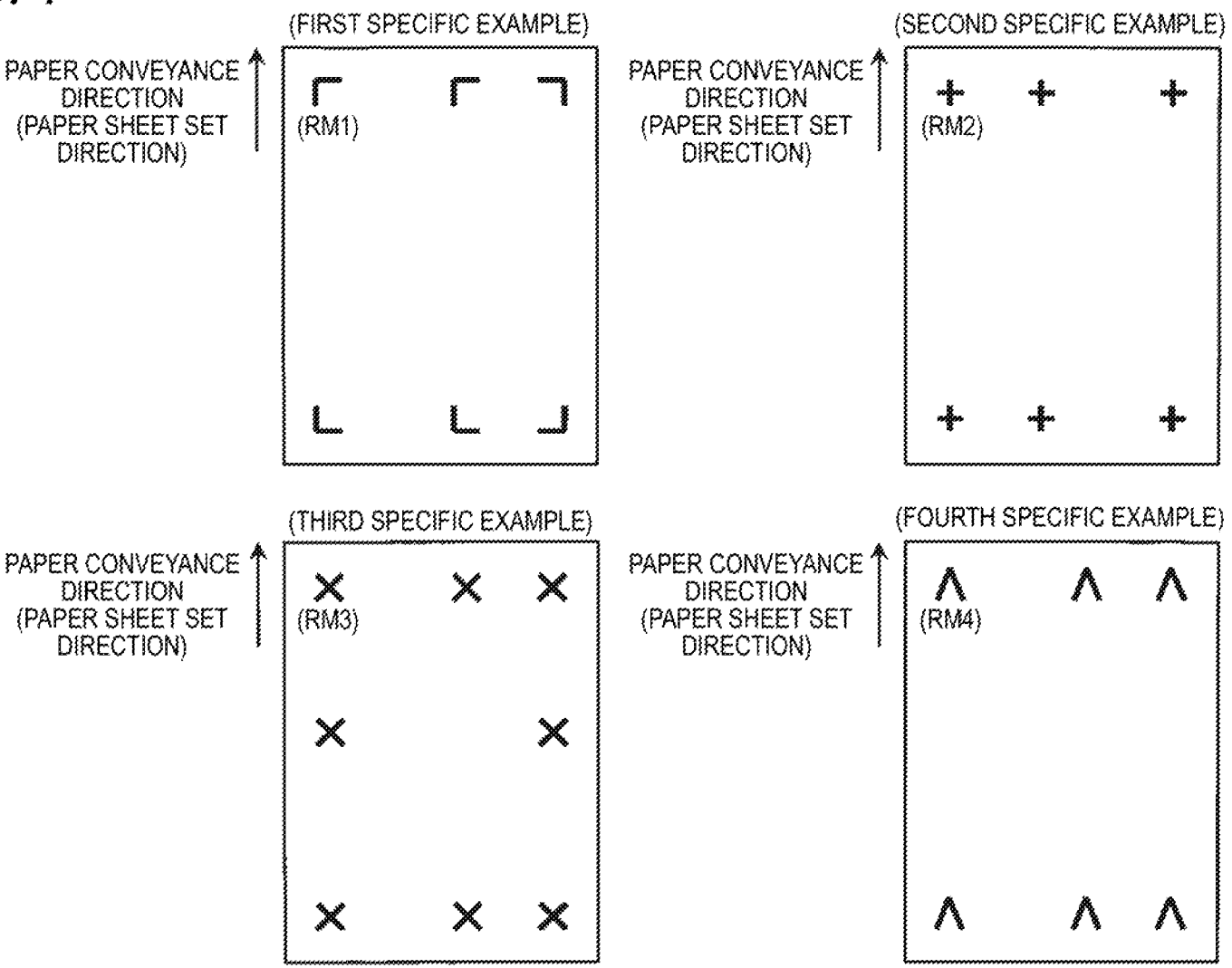
FIG. 7 is a view illustrating specific examples of charts each of which indicates reference positions.

FIG. 7 is a view illustrating specific examples of charts each of which indicates two or more reference positions. In each of First to Fourth specific examples of FIG. 7, reference marks RM1, RM2, RM3, or RM4 indicating reference positions are shown.

The first specific example of FIG. 7 shows the reference marks RM1 which are uncinate. For example, the corners of the uncinate reference marks RM1 indicate reference positions. In the first specific example, six reference marks RM1 indicate six reference positions. In other words, the six reference marks RM1 indicate four reference positions corresponding to four corners of a paper sheet, and two reference positions corresponding to two of the centers between the corners of the paper sheet. However, in the first specific example of FIG. 7, the two reference positions corresponding to the centers between the corners of the paper sheet are arranged so as to be slightly deviated from the centers to the right side.

For example, in the case of using the chart shown in the first specific example of FIG. 7 as a first chart, as a second chart, a chart including marks consisting of straight lines having directions different from the directions of straight lines constituting the uncinate reference marks RM1 can be used. Also, in the case of using the chart shown in the first specific example of FIG. 7 as a second chart, as a first chart, a chart including marks consisting of straight lines having directions different from the directions of the straight lines constituting the uncinate reference marks RM1 can be used.

In addition, in the first specific example of FIG. 7, the six reference marks RM1 are arranged so as to be asymmetric with respect to rotation of the directions of paper sheets. For example, the reference marks RM1 are arranged such that in the case of rotating a paper sheet (such rotation includes rotation of 90 degrees clockwise or counterclockwise and rotation of 180 degrees), the arrangement of the reference marks RM1 before rotation does not coincide with that after rotation.

Therefore, for example, if the first chart including the six reference marks RM1 shown in the first specific example of FIG. 7 is printed on a paper sheet, from the arrangement of the six reference marks RM1, it is possible to recognize the set direction of the paper sheet (the direction in which the paper sheet should be conveyed).

For example, if the first chart including the six reference marks RM1 is printed on a paper sheet during test printing related to pre-printing, from the arrangement of the six reference marks RM1, the user can recognize the set direction of the paper sheet for test printing related to post-printing. Therefore, the user can correctly set the paper sheet for post-printing. Alternatively, image display on a display device, a description in a manual, a description on a paper tray, and the like may be used to inform the user that the arrangement of the six reference marks RM1 shown in the first specific example of FIG. 7 is an arrangement corresponding to the correct set direction.

The second specific example of FIG. 7 shows the reference marks RM2 which have a plus sign shape. For example, the intersection points of the reference marks RM2 having the plus sign shape indicate reference positions. Even in the second specific example of FIG. 7, six reference marks RM2 are arranged so as to be asymmetric with respect to rotation of the directions of paper sheets, and indicate four reference positions corresponding to four corners of a paper sheet, and two reference positions corresponding to two of the centers between the corners of the paper sheet. However, in the second specific example of FIG. 7, the two reference positions corresponding to the centers between the corners of the paper sheet are arranged so as to be slightly deviated from the centers to the left side.

For example, in the case of using the chart shown in the second specific example of FIG. 7 as a first chart, as a second chart, a chart including marks consisting of straight lines having directions different from the directions of straight lines constituting the plus-sign-shaped reference marks RM2 can be used. Also, in the case of using the chart shown in the second specific example of FIG. 7 as a second chart, as a first chart, a chart including marks consisting of straight lines having directions different from the directions of the straight lines constituting the plus-sign-shaped reference marks RM2 can be used as a first chart.

Further, since the six reference marks RM2 shown in the second specific example of FIG. 7 are also arranged so as to be asymmetric with respect to rotation of the direction of paper sheets, for example, if a first chart including the six reference marks RM2 shown in the second specific example of FIG. 7 is printed on a paper sheet, from the arrangement of the six reference marks RM2, it is possible to recognize the set direction of the paper sheet (the direction in which the paper sheet should be conveyed).

The third specific example of FIG. 7 shows the reference marks RM3 which have an X shape. For example, the intersection points of the reference marks RM3 having the X shape indicate reference positions. In the third specific example of FIG. 7, eight reference marks RM3 are arranged so as to be asymmetric with respect to rotation of the directions of paper sheets, and indicate four reference positions corresponding to four corners of a paper sheet, and four reference positions corresponding to the centers between the corners of the paper sheet.

For example, in the case of using the chart shown in the third specific example of FIG. 7 as a first chart, as a second chart, a chart including marks consisting of straight lines having directions different from the directions of straight lines constituting the X-shaped reference marks RM3 can be used. Also, as a first chart, in the case of using the chart shown in the third specific example of FIG. 7 as a second chart, a chart including marks consisting of straight lines having directions different from the directions of the straight lines constituting the X-shaped reference marks RM3 can be used.

Further, since the eight reference marks RM3 shown in the third specific example of FIG. 7 are also arranged so as to be asymmetric with respect to rotation of the directions of paper sheets, for example, if the chart including the eight reference marks RM3 shown in the third specific example of FIG. 7 is printed as a first chart on a paper sheet, from the arrangement of the eight reference marks RM3, it is possible to recognize the set direction of the paper sheet (the direction in which the paper sheet should be conveyed).

The fourth specific example of FIG. 7 shows the reference marks RM4 which have an inverted V shape. For example, the corner of each of the reference marks RM4 having the inverted V shape indicates a reference position. Similarly to the first specific example of FIG. 7, even in the fourth specific example of FIG. 7, six reference marks RM4 are arranged so as to be asymmetric with respect to rotation of the directions of paper sheets, and indicate four reference positions corresponding to four corners of a paper sheet, and two reference positions corresponding to two of the centers between the corners of the paper sheet.

For example, in the case of using the chart shown in the fourth specific example of FIG. 7 as a first chart, as a second chart, a chart including marks consisting of straight lines having directions different from the directions of straight lines constituting the reference marks RM4 having the inverted V shape can be used. Also, in the case of using the chart shown in the fourth specific example of FIG. 7 as a second chart, as a first chart, a chart including marks consisting of straight lines having directions different from the directions of the straight lines constituting the reference marks RM4 having the inverted V shape can be used.

Further, since the six reference marks RM4 shown in the fourth specific example of FIG. 7 are also arranged so as to be asymmetric with respect to rotation of the directions of paper sheets, for example, if the chart including the six reference marks RM4 shown in the fourth specific example of FIG. 7 is printed as a first chart on a paper sheet, from the arrangement of the six reference marks RM4, it is possible to recognize the set direction of the paper sheet (the direction in which the paper sheet should be conveyed). Furthermore, in the fourth specific example of FIG. 7, since the direction of the corners of the reference marks RM4 having the inverted V shape indicates the set direction of the paper sheet, it is also possible to recognize the set direction of the paper sheet from the shape of the reference marks RM4.

However, the first to fourth specific examples shown in FIG. 7 are merely some specific examples related to charts each of which indicates two or more reference positions. For example, other charts each of which indicates two or more reference positions by the marks of the specific examples shown in FIG. 1 to FIG. 4 may be formed.

Figure 8:
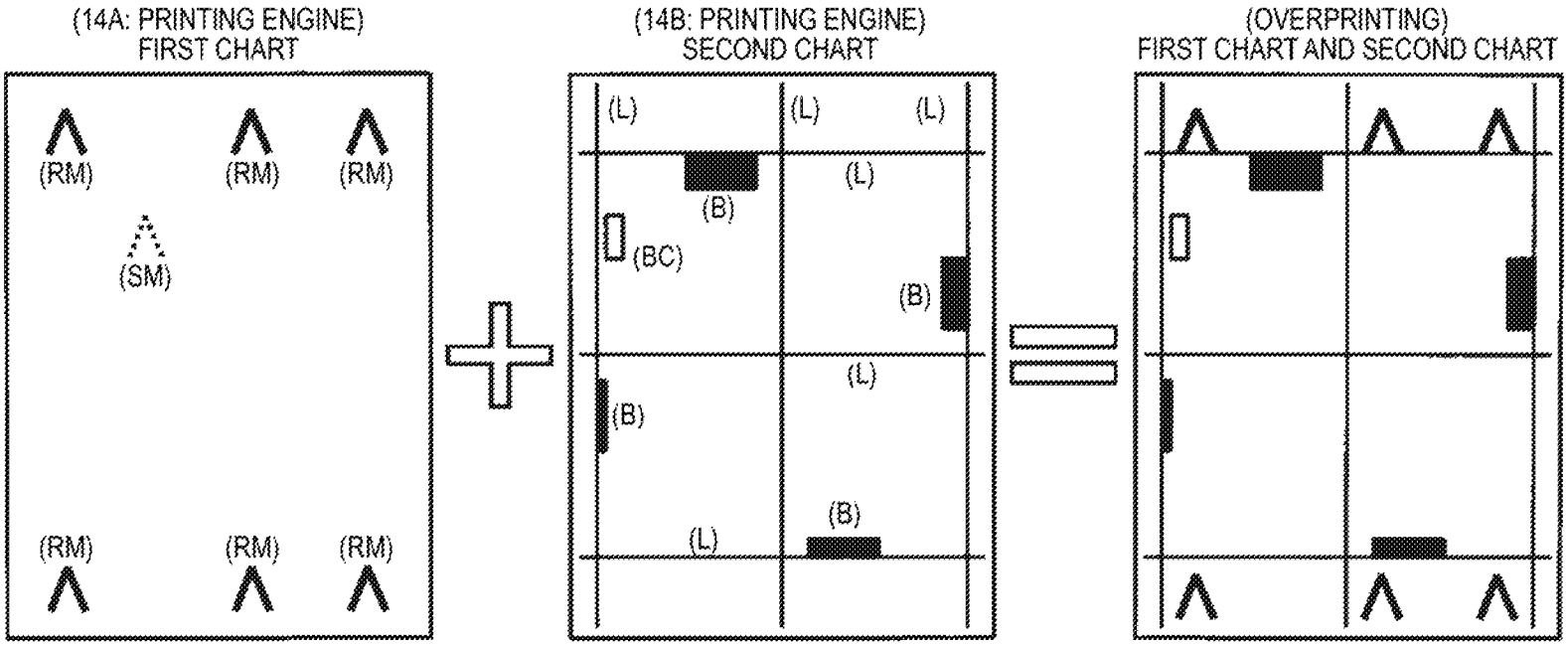
FIG. 8 is a view illustrating specific examples which can be used for adjustment for overprinting.

FIG. 8 is a view illustrating specific examples of charts which can be used for adjustment for overprinting. On the occasion of performing adjustment for overprinting, the printing engine 14A of the printing apparatus 10A prints a first chart indicating first reference positions by the intersection points of first reference lines, on a paper sheet (a medium), during test printing of pre-printing.

In FIG. 8, as a specific example of a first chart which can be used for adjustment for overprinting, a first chart including reference marks RM having an inverted V shape and indicating reference positions (see the fourth specific example of FIG. 7) is shown. For example, the corner of each reference mark RM having the inverted V shape indicates a reference position, and six reference marks RM indicate six reference positions. In other words, the six reference marks RM indicate four reference positions corresponding to four corners of a paper sheet, and two reference positions corresponding to two of the centers between the corners of the paper sheet.

Also, in the specific example shown in FIG. 8, the first chart includes a direction mark SM indicating a paper sheet direction (a paper sheet set direction for post-printing). In the specific example of FIG. 8, the direction mark SM indicates the paper sheet set direction (the direction in which paper sheets should be conveyed) by its shape (the direction of the corner).

For example, during test printing of pre-printing, the six reference marks RM may be printed on both of the front side and rear side of a paper sheet, and the direction mark SM may be printed on only the rear side. In this case, it is possible to recognize that the side having the direction mark SM printed thereon is the rear side.

In FIG. 8, a specific example of a second chart which can be used for adjustment for overprinting is also shown. On the occasion of performing adjustment for overprinting, the printing engine 14B of the printing apparatus 10B prints a second chart indicating second reference positions by the intersection points of second reference lines having directions different from the directions of the first reference lines, on the paper sheet (a medium), during test printing of post-printing.

In FIG. 8, as a specific example of a second chart which can be used for adjustment for overprinting, a second chart including straight lines L, bars B, and a barcode BC is shown. For example, each intersection point (a grid point) of two different straight lines L indicates a reference position (a search reference position). Also, the thicknesses of the bars B indicate a paper sheet direction. For example, the thickest bar B of four bars B is arranged on the lead side of post-printing. Further, the barcode BC representing information such as the front side and rear side of paper, the size of paper, and so on is included. In the specific example of FIG. 8, the straight lines L function as second reference lines. The straight lines L extend in the transverse direction and the longitudinal direction unlike the inclined straight lines constituting the reference marks RM of the first chart.

For example, during test printing of post-printing, the second chart may be printed on both of the front side and rear side of a paper sheet. Also, for example, a barcode BC representing information on the front side and rear side of paper may be printed on the front side of a paper sheet and a barcode BC representing paper size information may be printed on the rear side of the paper sheet.

On the occasion of performing adjustment for overprinting, the first chart is printed on a paper sheet during test printing of pre-printing, and the second chart is printed on the paper sheet having the first chart printed thereon during test printing of post-printing. In this way, the first chart and the second chart are printed on a paper sheet so as to overlap.

Also, prior to adjustment for overprinting, chart information on the first chart and the second chart is stored in the storage device 50. The chart information includes ideal position information representing an ideal position relationship between the first chart and the second chart.

Figure 9:
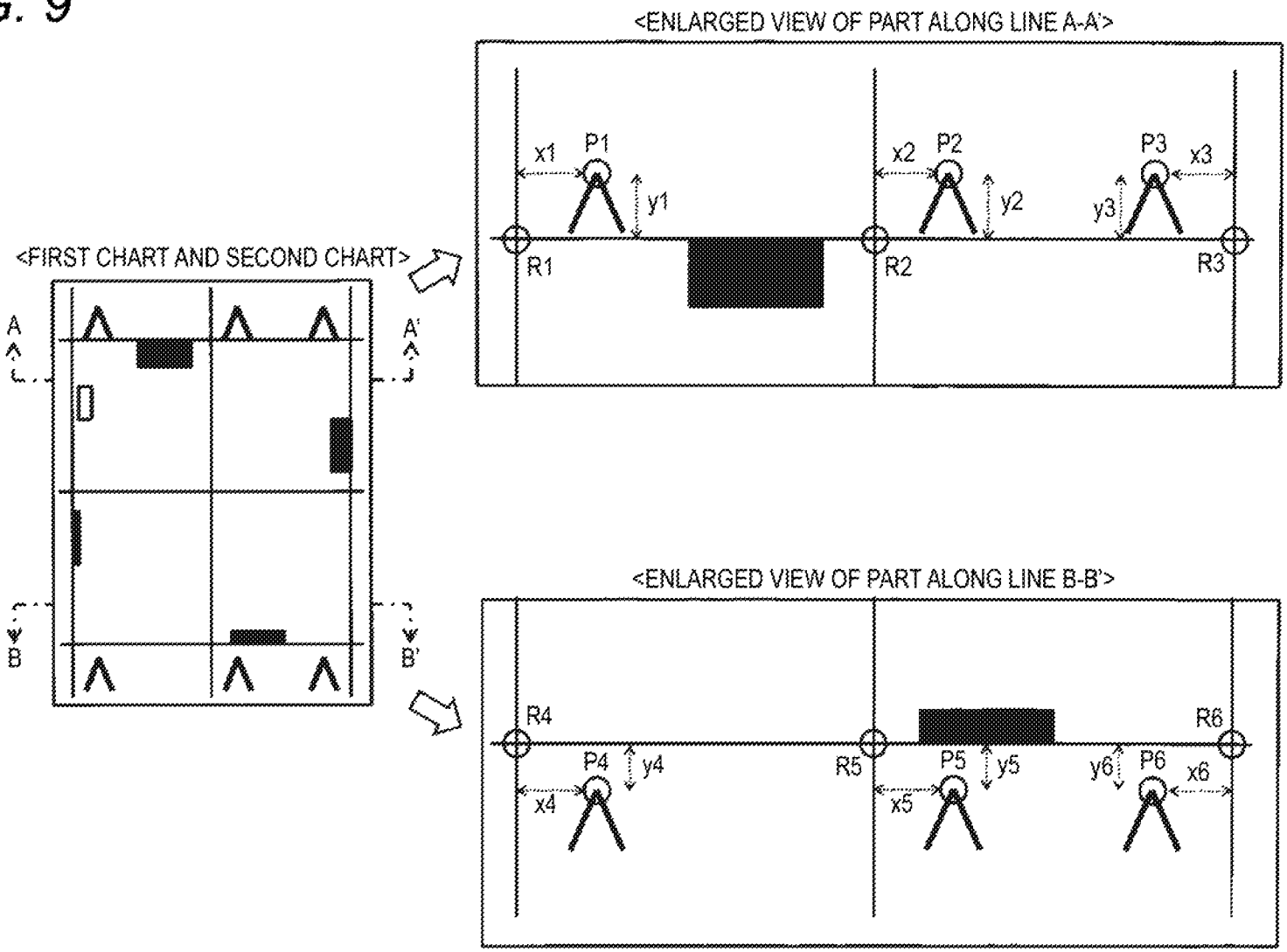
FIG. 9 is a view illustrating a specific example of ideal position information which is included in chart information.

FIG. 9 is a view illustrating a specific example of the ideal position information which is included in the chart information. In FIG. 9, ideal position information on the first chart and the second chart shown in FIG. 8 is shown.

In the specific example of FIG. 8, the first chart includes the six reference marks RM, and the six reference marks RM indicate six reference positions. In FIG. 9, the six reference positions are shown and are denoted by P1 to P6.

Also, in the specific example of FIG. 8, the second chart includes the straight lines L. and each intersection point (a grid point) of two different straight lines L indicates a search reference position. In FIG. 9, six search reference positions R1 to R6 corresponding to the six reference positions P1 to P6 are shown.

The ideal position information is information representing a position relationship between the first chart and the second chart which is obtained in the case where ideal overprinting is performed such that printing-position misalignment between pre-printing and post-printing does not occur. In the specific example shown in FIG. 9, as the ideal position information, ideal relative-position information between each pair of a reference position and a search reference position corresponding to each other, of the reference positions indicated by the first chart and the search reference positions indicated by the second chart is used.

For example, in the specific example shown in FIG. 9, the reference position P1 indicated by the first chart and the search reference position R1 indicated by the second chart correspond to each other, and the difference between the x coordinate values of the reference position P1 and the search reference position R1 and the difference between the y coordinate values of them which are obtained in the case of performing ideal overprinting become relative-position information (x1, y1).

Similarly, in the specific example shown in FIG. 9, relative-position information (x2, y2) of the reference position P2 and the search reference position R2, relative-position information (x3, y3) of the reference position P3 and the search reference position R3, relative-position information (x4, y4) of the reference position P4 and the search reference position R4, relative-position information (x5, y5) of the reference position P5 and the search reference position R5, and relative-position information (x6, y6) of the reference position P6 and the search reference position R6 become ideal relative-position information between the pairs of reference positions and search reference positions corresponding to each other.

In the storage device 50, for example, the ideal relative-position information between the pairs of reference positions and search reference positions corresponding to each other, shown as examples in FIG. 9, is stored as chart information.

Figure 10:
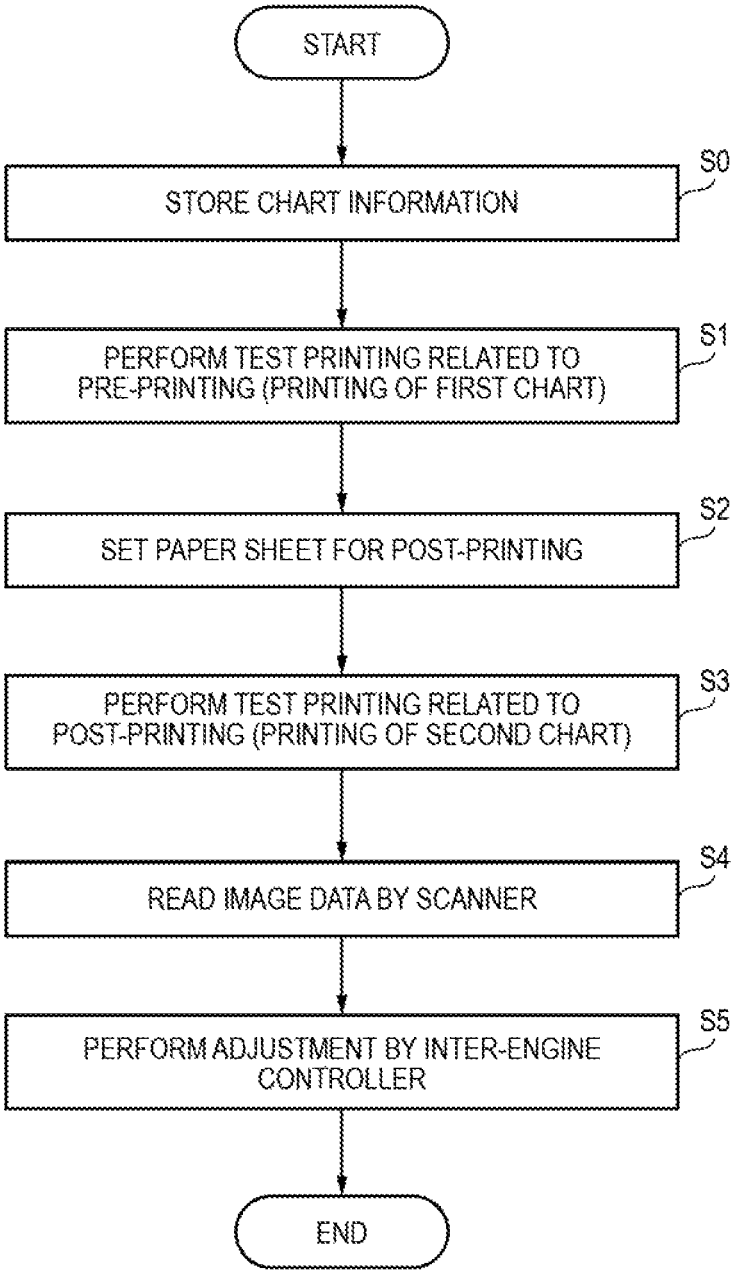
FIG. 10 is a view illustrating a specific example of the procedure of overprinting related to adjustment.

FIG. 10 is a view illustrating a specific example of the procedure of overprinting related to adjustment. In FIG. 10, a specific example of the procedure of overprinting related to adjustment which is performed by the printing system of FIG. 5 is shown by a flow chart. Examples of such adjustment include adjustment of image formation position misalignment between pre-printing and post-printing, magnification adjustment, and so on. Prior to adjustment for overprinting, chart information on a first chart and a second chart is stored in the storage device 50 (STEP S0). For example, with respect to the first chart and the second chart of the specific example shown in FIG. 8, chart information including the relative-position information (x1, y1) to (x6, y6) shown in FIG. 9 is stored in the storage device 50.

For adjustment for overprinting, first, test printing related to pre-printing is performed (STEP S1). For example, the user sets a paper sheet for test printing on a paper tray corresponding to the printing engine 14A of the printing apparatus 10A, and the user issues an instruction to perform test printing of the first chart by operating the operation device or the like of the printing apparatus 10A. As a result, the printing engine 14A prints the first chart.

Next, the user sets the paper sheet for post-printing (STEP S2). For example, after the first chart is printed on the paper sheet by test printing of STEP S1 related to pre-printing, if the paper sheet is output onto an output tray corresponding to the printing engine 14A of the printing apparatus 10A, the user sets the paper sheet on a paper tray corresponding to the printing engine 14B of the printing apparatus 10B.

When the user sets the paper sheet in STEP S2, if the first chart printed on the paper sheet indicates the set direction of the corresponding paper sheet (the paper sheet should be conveyed) (see the fourth specific example of FIG. 7 for instance), with reference to the set direction indicated by the first chart printed on the paper sheet, the user sets the paper sheet on the paper tray corresponding to the printing engine 14B of the printing apparatus 10B such that the direction of the paper sheet coincides with the correct direction. In this way, it is possible to correctly set the paper sheet for post-printing. Alternatively, for example, an image indicating the correct direction of the paper sheet (for example, the correct direction of the first chart) may be displayed on a display device included in the printing apparatus 10B, or a drawing or the like indicating the correct direction of the paper sheet may be provided on the paper tray corresponding to the printing engine 14B or around the paper tray.

If the paper sheet for post-printing is set, test printing related to post-printing is performed (STEP S3). For example, the user issues an instruction to perform test printing of the second chart by operating the operation device or the like of the printing apparatus 10B. As a result, the printing engine 14B prints the second chart.

Next, reading of image data is performed by the scanner 30 (STEP S4). For example, after the first chart is printed on the paper sheet by test printing of STEP S1 related to pre-printing and the second chart is printed on the paper sheet by test printing of STEP S3 related to post-printing, if the paper sheet is output onto the output tray corresponding to the printing engine 14B of the printing apparatus 10B, the user sets the paper sheet on the scanner 30, and issues an instruction to read image data. As a result, image data of the first chart and the second chart printed by overprinting is read.

Subsequently, the data acquiring unit 42 of the inter-engine controller 40 acquires the image data read by the scanner 30, and an adjustment process for overprinting is performed by the inter-engine controller 40 (STEP S5).

If the data acquiring unit 42 acquires image data, the detecting unit 44 detects straight lines from the image data (see FIG. 6), and detects reference positions which are the intersection points between the straight lines.

For example, in the case of the first chart and the second chart of the specific example shown in FIG. 8, if the angle of each reference mark RM having the inverted V shape (the interior angle of the inverted V shape) and included in the first chart is an acute angle (not an obtuse angle), from the difference between the angle of the reference marks and the intersection angle (a right angle) of the straight lines L included in the second chart, it is possible to discriminate straight lines constituting the reference marks RM.

Therefore, it is possible to discriminate between the first reference positions indicated by the reference marks RM included in the first chart and the second reference positions indicated by the intersection points of the straight lines L included in the second chart, and detect the first and second reference positions.

Also, in the case of the first chart and the second chart of the specific example shown in FIG. 8, since the length of the straight lines constituting the reference marks RM included in the first chart and having the inverted V shape is shorter than (equal to or shorter than half of) the length of the straight lines L included in the second chart, from the lengths of the straight lines, it is possible to discriminate between the straight lines constituting the reference marks RM of the first chart and the straight lines L included in the second chart, and detect the straight lines.

Therefore, for example, in the case of the first chart and the second chart of the specific example shown in FIG. 8, from the image data, the six reference positions P1 to P6 (FIG. 9) are detected as the first reference positions, and the six search reference positions R1 to R6 (FIG. 9) are detected as the second reference positions.

The misalignment amount deriving unit 46 of the inter-engine controller 40 derives the amount of misalignment between the printing position of pre-printing and the printing position of post-printing, using the relative position relationship between the first reference positions and the second reference positions detected from the image data. For example, from the reference position P1 (see FIG. 9) and the search reference position R1 (see FIG. 9) detected from the image data, a relative position (x1, y1) between them is obtained. Further, from the difference between the detected relative position (x1, y1) and the ideal relative position (x1, y1) included in the chart information acquired from the storage device 50, a misalignment amount corresponding to the reference position P1 (the search reference position R1) is derived.

Also, from the reference position P2 (see FIG. 9) and the search reference position R2 (see FIG. 9) detected from the image data, a relative position (x2, y2) between them is obtained. Further, from the difference between the detected relative position (x2, y2) and the ideal relative position (x2, y2) acquired from the storage device 50, a misalignment amount corresponding to the reference position P2 (the search reference position R2) is derived. Furthermore, from the differences between relative positions (x3, y3) to (x6, y6) obtained from the detection results and the ideal relative positions (x3, y3) to (x6, y6) included in the chart information, misalignment amounts corresponding to the reference positions P3 to P6 (the search reference positions R3 to R6) are derived.

For example, a first chart including four reference positions corresponding to four corners of a paper sheet and two reference positions corresponding to two of the centers between the corners of the paper sheet like the first chart shown in FIG. 8 is suitable to detect general printing-position misalignment of a printable area on a paper sheet.

In this case, if the misalignment amounts corresponding to the reference positions P1 to P6 (the search reference positions R to R6) are obtained, adjustment according to the misalignment amounts is performed, and then overprinting is performed. For example, printing of the user's images which are print objects based on the printing instruction received from the user are performed as main printing. In other words, printing of the user's images is performed as pre-printing on paper sheets by the printing apparatus 10A, and then post-printing is performed on the paper sheets subjected to the pre-printing by the printing apparatus 10B. For main printing, the post-printing position of the printing engine 14B of the printing apparatus 10B is adjusted such that the misalignment amounts derived by the misalignment amount deriving unit 46 are eliminated (such that the misalignment is eliminated). Alternatively, for main printing, according to the misalignment amounts derived by the misalignment amount deriving unit 46, the pre-printing position of the printing engine 14A of the printing apparatus 10A may be adjusted, or both of the printing engines 14A and 14B may be adjusted.

Also, during test printing of pre-printing, pre-printing of a first chart and a user's image which is an object of main printing may be performed, and during test printing of post-printing, post-printing of a second chart and the user's image may be performed. In this case, for example, it is possible to obtain the amount of printing-position misalignment in a printing condition similar to that for main printing.

Although the exemplary embodiment of the present invention has been described above, the above-described exemplary embodiment is merely illustrative in every respect, and does not limit the scope of the present invention. The invention may encompass various modifications within a range which does not depart from the gist thereof.

What is claimed is:

1. A printing apparatus comprising:

a memory storing a program; and at least one hardware processor configured to execute a process in the program, the process comprises:

performing at least one printing operation of pre-printing and post-printing of overprinting which is an operation of performing pre-printing on a medium and then performing post-printing on the medium; and printing at least one chart indicating reference positions by intersection points of reference lines, during test printing related to the at least one printing operation, in such a manner that directions of reference lines corresponding to pre-printing are different from directions of reference lines corresponding to post-printing.

2. The printing apparatus according to claim 1, wherein:

during the test printing related to the at least one printing operation, at least one chart is printed, wherein an angle between the reference lines corresponding to pre-printing is different from an angle between the reference lines corresponding to post-printing.

3. The printing apparatus according to claim 2, wherein:

during the test printing related to the at least one printing operation, at least one chart is printed, wherein a color of the reference lines corresponding to pre-printing is different from a color of the reference lines corresponding to post-printing.

4. The printing apparatus according to claim 2, wherein:

during the test printing related to the at least one printing operation, at least one chart is printed, wherein a line type of the reference lines corresponding to pre-printing is different from a line type of the reference lines corresponding to post-printing.

5. The printing apparatus according to claim 2, wherein:

during the test printing related to the at least one printing operation, at least one chart is printed, wherein positions of the reference lines corresponding to pre-printing are different from positions of the reference lines corresponding to post-printing.

6. The printing apparatus according to claim 1, wherein:

during the test printing related to the at least one printing operation, at least one chart is printed, wherein a color of the reference lines corresponding to pre-printing is different from a color of the reference lines corresponding to post-printing.

7. The printing apparatus according to claim 6, wherein:

during the test printing related to the at least one printing operation, at least one chart is printed, wherein a line type of the reference lines corresponding to pre-printing is different from a line type of the reference lines corresponding to post-printing.

8. The printing apparatus according to claim 6, wherein:

during the test printing related to the at least one printing operation, at least one chart is printed, wherein positions of the reference lines corresponding to pre-printing are different from positions of the reference lines corresponding to post-printing.

9. The printing apparatus according to claim 1, wherein:

during the test printing related to the at least one printing operation, at least one chart is printed, wherein a line type of the reference lines corresponding to pre-printing is different from a line type of the reference lines corresponding to post-printing.

10. The printing apparatus according to claim 9, wherein:

during the test printing related to the at least one printing operation, at least one chart is printed, wherein positions of the reference lines corresponding to pre-printing are different from positions of the reference lines corresponding to post-printing.

11. The printing apparatus according to claim 1, wherein:

during the test printing related to the at least one printing operation, at least one chart is printed, wherein a positions of the reference lines corresponding to pre-printing are different from a positions of the reference lines corresponding to post-printing.

12. A printing system for performing overprinting which is an operation of performing pre-printing on a medium and then performing post-printing on the medium, comprising:

a first printing unit that prints a first chart indicating a first reference position by an intersection point of first reference lines, on the medium, during test printing related to the pre-printing;

a second printing unit that prints a second chart indicating a second reference position by the intersection point of second reference lines having directions different from directions of the first reference lines, on the medium having the first chart printed on the medium, during test printing related to the post-printing;

a reading unit that reads image data of the first chart and the second chart printed on the medium; and a detecting unit that detects the first reference lines of the pre-printing and the second reference lines of the post-printing from the image data read by the reading unit.

13. The printing system according to claim 12, wherein:

the first printing unit and the second printing unit print the first chart and the second chart in which an angle between the first reference lines is different from an angle between the second reference lines, and the detecting unit discriminates between the first reference lines and the second reference lines, from an angle difference between the reference lines detected from the image data, and detects the first reference position from the first reference lines, and detects the second reference position from the second reference lines.

14. The printing system according to claim 12, wherein:

the first printing unit and the second printing unit print the first chart and the second chart in which a color of the first reference lines is different from a color of the second reference lines, and the detecting unit discriminates between the first reference lines and the second reference lines, from the difference between the colors of the reference lines detected from the image data, and detects the first reference position from the first reference lines, and detects the second reference position from the second reference lines.

15. The printing system according to claim 12, wherein:

the first printing unit and the second printing unit print the first chart and the second chart in which a line type of the first reference lines is different from a line type of the second reference lines, and the detecting unit discriminates between the first reference lines and the second reference lines, from the difference between the line types of the reference lines detected from the image data, and detects the first reference position from the first reference lines, and detects the second reference position from the second reference lines.

16. The printing system according to claim 12, wherein:

the first printing unit and the second printing unit print the first chart and the second chart in which positions of the first reference lines are different from positions of the second reference lines, and the detecting unit discriminates between the first reference position and the second reference position, from the difference between the positions in the image data, and detects the first reference position and the second reference position.

17. The printing system according to claim 12, wherein:

from the image data, the detecting unit detects a plurality of straight lines constituting the first reference lines, and detects the intersection point of the plurality of straight lines, as the first reference position, and detects a plurality of straight lines constituting the second reference lines, and detects the intersection point of the plurality of straight lines, as the second reference position.

18. The printing system according to claim 12, further comprising:

a deriving unit that derives an amount of misalignment between a printing position of the pre-printing and the printing position of the post-printing, using the relative position relationship between the first reference position and the second reference position detected by the detecting unit.

19. The printing system according to claim 18, wherein:

according to the derived misalignment amount, at least one of the printing position of the pre-printing on the medium and the printing position of the post-printing on the medium is adjusted, and the overprinting is performed on the medium.

20. A non-transitory computer readable medium storing a program causing a computer to execute a process for printing, the process comprising:

controlling a printing engine such that the printing engine performs at least one operation of pre-printing and post-printing of overprinting which is an operation of performing pre-printing on a medium and then performing post-printing on the medium; and controlling the printing engine such that the printing engine prints at least one chart indicating reference positions by intersection points of reference lines, during test printing related to the at least one printing operation, in such a manner that directions of reference lines corresponding to pre-printing are different from directions of reference lines corresponding to post-printing.

* * * * *